United States Patent [19]

Solow

[11] Patent Number: 4,754,548

[45] Date of Patent: Jul. 5, 1988

[54] FLEXIBLE, SECTIONALIZED CONTOUR RAZOR

[76] Inventor: Terry S. Solow, 410 Playa Blvd., La Selva Beach, Calif. 95076

[21] Appl. No.: 939,625

[22] Filed: Dec. 8, 1986

Related U.S. Application Data

[63] Continuation-in-part of Ser. No. 773,871, Sep. 9, 1985, abandoned.

[51] Int. Cl.[4] ..... B26B 21/00

[52] U.S. Cl. ..... 30/50; 30/32; 30/89

[58] Field of Search ..... 30/32, 47–50, 30/89

[56] References Cited

FOREIGN PATENT DOCUMENTS 52-15761 3/1977 Japan ..... 30/50

*Primary Examiner*—Douglas D. Watts

[57] ABSTRACT

A flexible, sectionalized razor system is provided for shaving rounded or variably contoured shaving surfaces. The system includes a plurality of individual blade-housings, each of which carries a separate blade, wherein the blade-housings are connected by connecting means of either ribs, resilient foam, soft rubber or spring means to a handle. In the preferred embodiment, the blade housings are arranged in such a fashion so as to avoid unshaved ribbons of the shaving surface caused by gaps between adjacent blade-housings. The blade-housings may be mounted peripendicularly to the direction of shaving or angularly to the direction of shaving. Another embodiment provides two parallel rows of blade-housings wherein one row is staggered with respect to the other row.

35 Claims, 3 Drawing Sheets

FIG. 16.
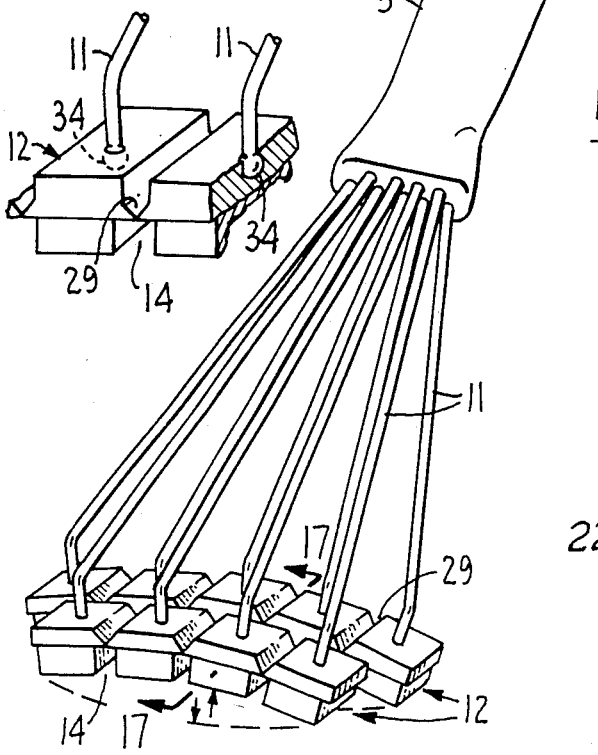
FIG. 15.
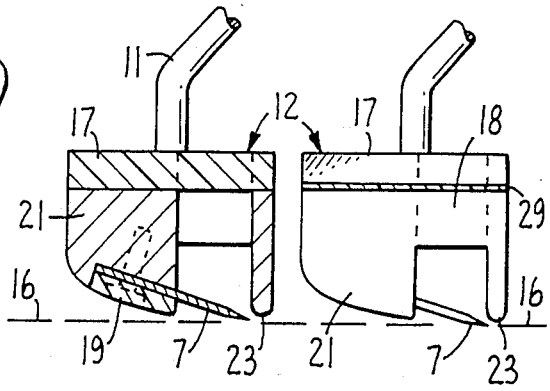
FIG. 17.
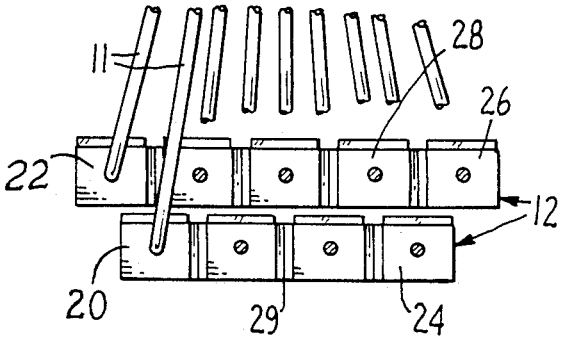
FIG. 18.
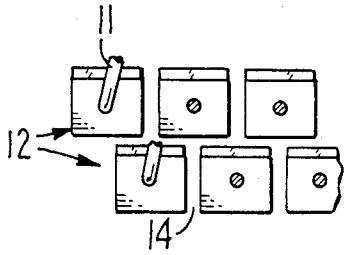
FIG. 19.
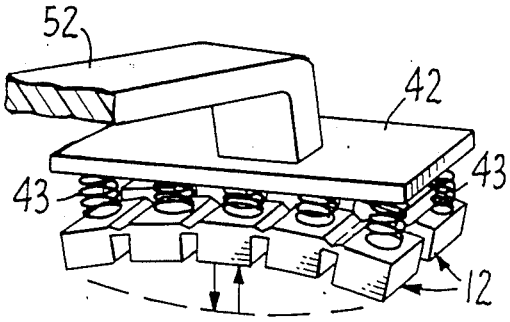
FIG. 21.
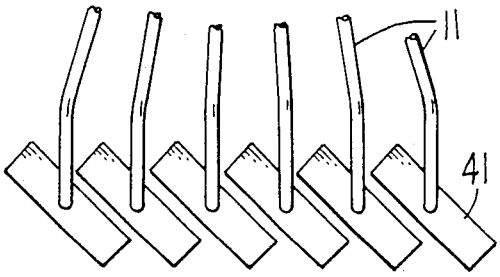
FIG. 20.

FLEXIBLE, SECTIONALIZED CONTOUR RAZOR

REFERENCE TO RELATED APPLICATION

This application is a Continuation-In-Part of my application Ser. No. 06/773,871, filed Sept. 9, 1985, titled SECTIONALIZED CONTOUR RAZOR, now abandoned.

SUMMARY OF THE INVENTION

The present invention relates to a flexible razor system for shaving large, rounded or variably contoured shaving surfaces such as legs, arms, thighs, underarms and head. Much like trying to peel an apple with a straight-edged knife, the conventional straight-edged razor takes relatively many strokes to accomplish a thorough shave on a rounded or contoured surface because of the relatively short contact length between the straight-edged razor and a curved shaving surface. This makes the shaving of any large, rounded or contoured body surface time-consuming and tedious.

The present invention teaches the use of a sectionalized razor system in which a plurality of rigid, individual blade-housings are used. Said razor system is adapted to automatically flex in order to closely conform to the contoured surface being shaved. The use of a plurality of individual blade-housings achieves a very wide shaving swath on any rounded or contoured surface that is far wider than it is possible to achieve with a straight-edged razor. Additionally, the wider shaving swath provided by the present invention requires far fewer strokes than a conventional razor in order to accomplish thorough shaving of rounded or variably contoured surfaces. Also, there is less likelihood of inadvertently missing ribbons of shaving surface because of the much longer cutting swath of the razor system versus that of a conventional straight-edged razor.

A primary object of this invention is to provide a flexible sectionalized razor system that, in any single stroke, is able to produce a dramatically wider, uniform shaving swath on any rounded or contoured surface than any other prior art razor. This much wider shaving swath greatly reduces the time necessary to shave large, contoured areas of the body because fewer strokes are required.

A second object of this invention is to provide a flexible sectionalized razor system using a plurality of individual blade-housings in which each of said blade-housings is free to tilt or move in order to closely follow its own local shaving surface contour.

A third object of this invention is to provide a way of achieving essentially equal contact forces for each of said plurality of blade-housings against any rounded or contoured shaving surface. This is very important because too much force on any one of said blade-housings will cut or abrade the skin being shaved, while too little force will leave the skin improperly shaved. The configurations shown in the present inventions inherently make all the forces on said plurality of blade-housings approximately equal. The razor system user may, therefore, select and control any desired overall shaving force without disturbing the inherent equality of each individual blade-housing's force against the shaving surface.

As a result, the razor system provides a uniform and thorough shaving of any rounded or contoured shaving surface.

Various other features and advantages of the invention will be brought out in the balance of this specification.

BRIEF DESCRIPTION OF THE DRAWINGS

FIG. 15 is a perspective view of another embodiment of this invention employing long, resilient ribs.

FIG. 16 is a perspective view, partially in section, of an alternative embodiment to that shown in FIG. 15, employing ball-joint swivels.

FIG. 17 is a view on line 17—17, partially in section, of the embodiment shown in FIG. 15.

FIG. 18 is an elevational view of a portion of the embodiment of FIG. 15.

FIG. 19 is an elevational view showing a hingeless alternative embodiment of the blade housings that are shown in FIG. 18.

FIG. 20 is an elevational view of another embodiment of this invention showing a single row of angularly positioned, overlapping blade-housings.

FIG. 21 is a perspective view of an embodiment of this invention employing spring means attached to a rigid housing.

DESCRIPTION OF THE PREFERRED EMBODIMENTS

An embodiment of this invention is shown in FIGS. 1 through 5. In this embodiment, the blade-housings 12 are injection-molded or mechanically attached to two plastic straps 20 and 22 containing v-grooved hinges 53.

Figure 3:
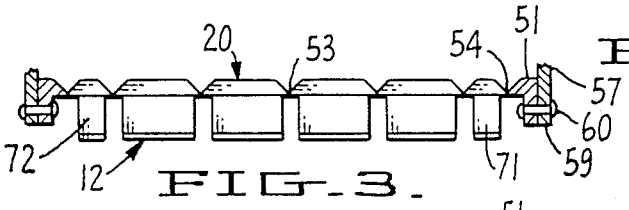
FIG. 3 is a sectional view on the line 3—3 of FIG. 2.

Swivel brackets 51 are hinged 54 to the ends of razor housing straps 20 and 22 in order to allow these straps to flex about swivel brackets 51 during shaving. While strap 22 contains only blade-housings 12, strap 20 contains blade-housings 12 plus two "dummy" housings 71 and 72. Said "dummy" housings act to fill in the resulting spaces that are created by the fact that the blade-housings 12 in FIG. 3 are staggered with respect to those in FIG. 4. This keeps the ends of strap 20 from buckling during shaving.

Figure 4:
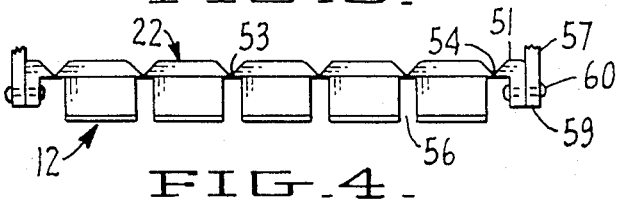
FIG. 4 is a sectional view on the line 4—4 of FIG. 2.

The front row gaps 56 between blade-housings 12 shown in FIG. 4 cause unshaved ribbons during shaving. These unshaved ribbons are shaved by the staggered blade-housings 12 of the rear row shown in FIG. 3.

Figure 1:
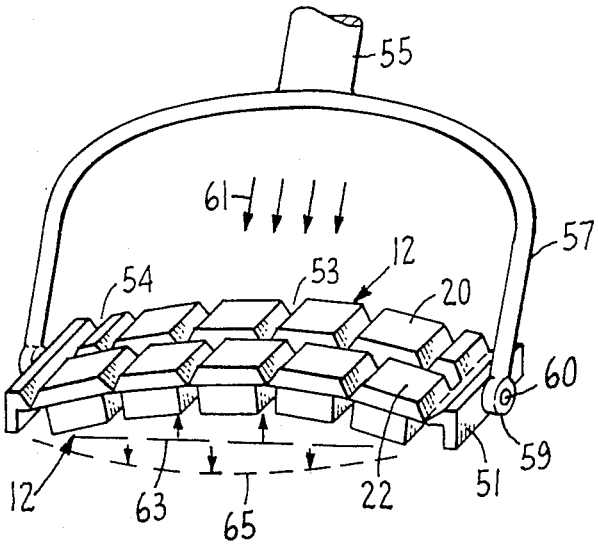
FIG. 1 is a perspective view of a razor system embodying the present invention.
Figure 2:
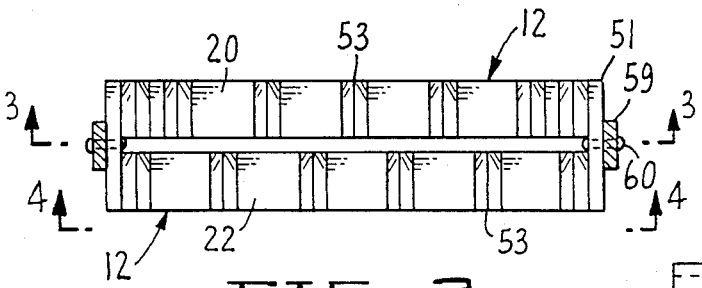
FIG. 2 is an elevational view of a portion of the embodiment shown in FIG. 1.
Figure 5:
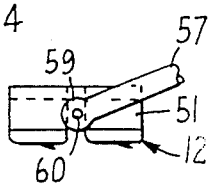
FIG. 5 is a side view of a portion of the embodiment shown in FIG. 1.

FIG. 1 shows how handle 55 swivels about blade-housings 12 by means of swivels 59, which are attached to swivel brackets 51 by pins 60. This allows handle 55 to swivel about pins 60 via ribs 57 during shaving. To shave a concave surface, such as the underarms, the user simply grasps handle 55 and pushes straps 20 and 22 outward as shown by arrows 61 to position 65 with a forefinger and/or an index finger.

Figure 8:
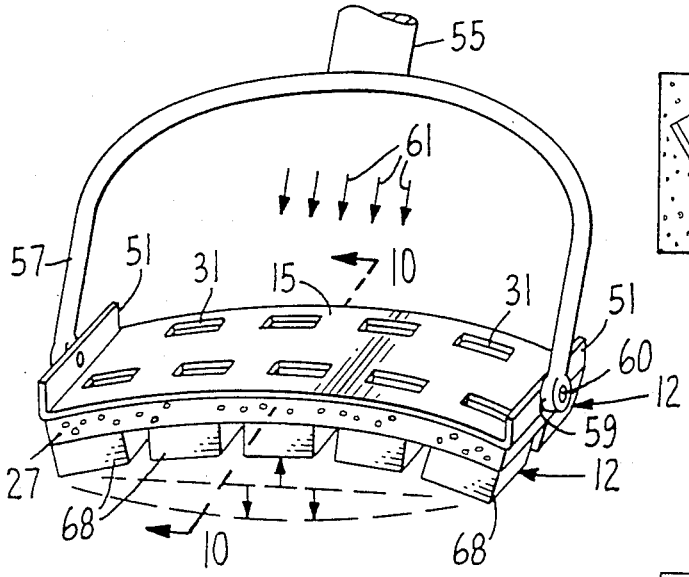
FIG. 8 is a perspective view of another embodiment of this invention embodying a flexible strap and a long continuous slab of resilient plastic foam.

A lady may shave her legs while standing erect by employing a long extension-handle (not shown) attached to the end of handle 55 of FIGS. 1, 8 or 15. This approach is only practical with the very wide, contour-hugging swath of this invention, while the narrow swath and the sliding askew tendency of a conventional straight-edged razor would make said extension-handle impractical.

Figure 6:
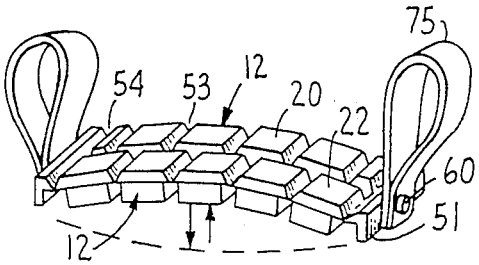
FIG. 6 is a perspective view of a handheld embodiment of the invention employing finger loops.

Another embodiment of this invention is shown in FIG. 6 as a handheld, compact version. Blade-housings 12 and plastic straps 20 and 22 are similar to those in FIG. 1. However, rather than employing a single handle 55, two loops 75 which comprise handle and rib means in this embodiment are attached to brackets 51 via pins 60. This allows the user to put a thumb through one loop and a little finger through the other loop while grasping the tops of the blade-housings 12 with the remaining fingers. The user's fingers act as additional rib means and provide the necessary forces to keep all blade-housings 12 in contact with a contoured surface during shaving.

Figure 7:
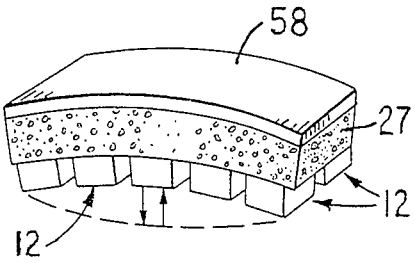
FIG. 7 is a perspective view of an alternative handheld embodiment of this invention employing resilient plastic foam.

Another handheld, compact embodiment of this invention is shown in FIG. 7. This embodiment employs blade-housings 12 in a similar manner to that shown in FIG. 6. However, loops 75, straps 20 and 22 have been eliminated. Polyurethane foam 27 is added and is glued to the tops of blade-housings 12. Optionally, a flexible, resilient cover 58 may be added and then glued to the top of said foam 27. The user simply cups this handheld version in the palm of her hand and proceeds to shave. The palm's pressure causes polyurethane foam 27 to compress and thus evenly distributes the force to all parts of blade-housings 12. This enables uniform shaving of all contoured shaving surfaces.

Another embodiment of this invention is shown in FIG. 8. This embodiment is similar to that shown in FIG. 1. However, FIG. 8 shows a wide flexible thin strap 15 glued to a long slab of polyurethane foam 27. Each individual blade-housing 68 of the group of blade-housings 12 is glued to said polyurethane foam 27 which is very pliant and resilient. This characteristic enables individual blade-housings 68 to tilt in any direction that is dictated by the contour of the shaving surface 16, virtually independent of the tilting of any of the other blade-housings 68. Holes 31 enable shavings and lather to escape without clogging.

Figure 10:
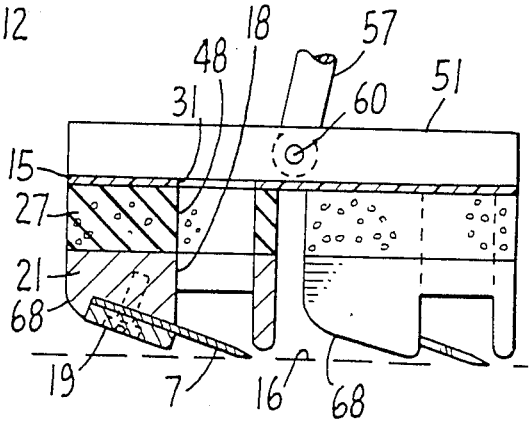
FIG. 10 shows a view, partially in section, on line 10—10 of the embodiment shown in FIG. 8.

FIG. 10 shows a view on line 10—10 of the embodiment shown in FIG. 8. Here, one can better see the exit path of the shavings and lather. After the hairs are cut by blade 7 as it shaves the surface 16, the shavings and lather pass up through a hole 18 in the roof of blade-housing 68 and then through a hole 48 in foam 27 and finally through exit hole 31 in flexible cover 15.

Figure 9:
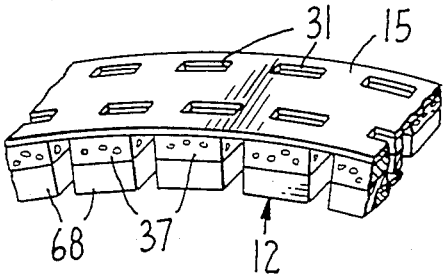
FIG. 9 is a perspective view, partially in section, of an alternative embodiment of this invention employing a flexible strap and a plurality of individual resilient plastic foam sections.

An alternative embodiment of this invention to that shown in FIG. 8 is shown in FIG. 9. Here, the long slab of polyurethane foam 27 shown in FIG. 8 has been cut into individual sections 37 for each blade-housing 68. This allows the blade-housings to tilt even further and more easily as compared to employing the long foam slab 27 shown in FIG. 8.

Figure 11:
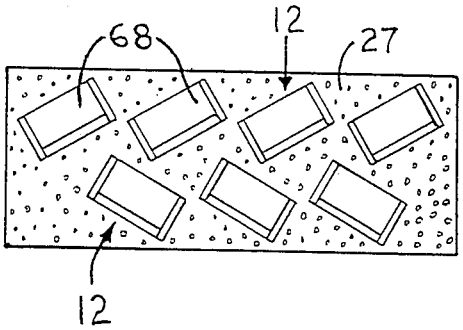
FIG. 11 shows an embodiment of this invention employing two rows of angularly positioned, overlapping blade-housings.

FIG. 11 shows an embodiment of this invention showing an alternative arrangement of blade-housings 12 to that shown in FIG. 8. Here, blade-housings 12 overlap and therefore, leave no unshaved ribbons. Additionally, said blade-housings 12 are inclined to the direction of the shaving stroke so as to more easily slice and cut the hairs on the shaving surface. The blade-housings 12 of the first row are inclined in an opposite direction to the blade-housings 12 of the second row in order to minimize lateral movement during shaving.

Figure 12:
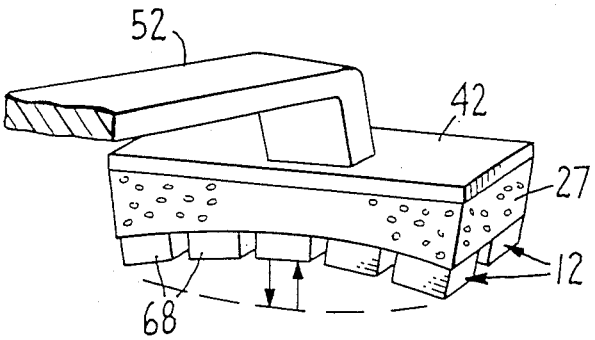
FIG. 12 shows a perspective view of another embodiment of this invention employing resilient foam attached to a rigid housing.

FIG. 12 shows another embodiment of this invention. Here, handle 52 is connected to a rigid razor-housing cover 42. Foam 27 is resilient and pliable and is attached to rigid razor-housing cover 42 on one side and blade-housings 12 on the opposite side. During shaving of a contoured shaving surface, blade-housings 12 tilt and/or move as dictated by the slope of said contoured shaving surface. Foam 27 expands and contracts in a resilient, pliable fashion in order to accommodate said blade-housings movement.

Figure 13:
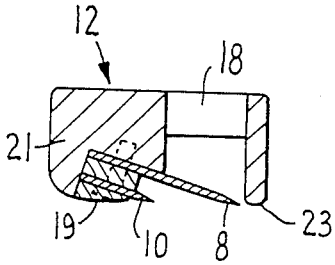
FIG. 13 is a sectional view of an alternative dual-bladed housing variation, for use in any of the embodiments shown in this invention.

FIG. 13 shows another conventional option of using dual blades 8 and 10 instead of single blade 7 shown in FIG. 10 for each of said blade-housings 12.

Figure 14:
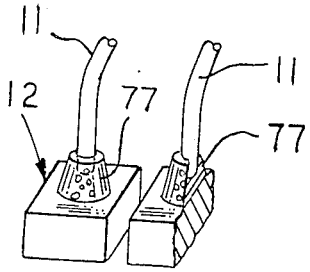
FIG. 14 is a perspective view, partially in section, of an alternative embodiment to that shown in FIG. 15, employing flexible and resilient foam sections acting as omnidirectional swivels.

FIG. 14 shows an alternative embodiment of this invention to the embodiment shown in FIG. 16. Rubbery, resilient, flexible sections 77 may be made of polyurethane foam, soft rubber or other similar material. Said foam sections 77 attach blade-housings 12 to flexible, resilient ribs 11. The cross-section of ribs 11 shown here are circular, but any cross-sectional shape may be used. Foam sections 77 provide low-cost, omnidirectional swivels for blade housings 12. Said swivels allow each of blade-housings 12 to flex in any direction in order to remain perpendicular to any rounded or variably contoured shaving surface during shaving. Thus, a much lower force may now be applied by the user to the razor handle in order to achieve said perpendicular shaving result versus the no-swivel approach shown in FIG. 15. Additionally, said resilient foam sections 77 furnish a return-to-center position force to each of blade-housings 12 when the razor is disengaged from the shaving surface.

Referring to the embodiment shown in FIGS. 15, 17 and 18, the flexible, sectionalized razor system shown is used for shaving any rounded or variably contoured shaving surface 16. The user simply grasps handle 5, and pushes the razor towards said shaving surface 16. Thus, ribs 11, which are flexible and resilient rods carried by handle 5, bend during each shaving stroke and force each of blade-housings 12 into perpendicular contact with shaving surface 16. Blade-housings 12 are connected together by v-grooved plastic hinges 29.

Hinges 29 extend along the side of each blade-housing 12 and each hinge consists of a thin, flexible strip of plastic that is attached to an adjacent blade-housing. Blade-housings 12 flex about hinges 29 as dictated by the contour of shaving surface 16. Since each of blade housings 12 is individually connected to handle 5 by means of long, resilient ribs 11, each blade-housing 12 is pushed with substantially equal force toward the shaving surface 16, independently. Therefore, blade-housings 12 will flex and move automatically so as to follow any contour of the shaving surface, since ribs 11 act as resilient, flexible springs. The v-grooved plastic hinges 29 prevent any of blade-housings 12 from slipping askew on very steeply contoured portions of the shaving surface 16.

Blade-housings 12 are arranged in two parallel rows, as shown in FIGS. 15 and 18. The blade-housings 12 in one of these rows are staggered relative to those of the other row to insure that the gaps 14 between blade-housings 12 that would cause ribbons of shaving surface to be missed are properly shaved. As shown in FIG. 18, typical blade-housings 22, 26 and 28 are in the front row and are staggered relative to typical blade-housings 20 and 24 which are in the rear row. This staggered procedure is continued for all the other blade-housings 12 shown in FIG. 18.

FIG. 16 shows an alternative embodiment of this invention to that shown in FIG. 15, wherein ball-joint swivels 34 connect ribs 11 to blade-housings 12. This allows the flexing and/or pitching motion of blade-housings 12 during contour shaving to be achieved in a more efficient way. That is, less rib-bending force is now required by the user when pushing handle 5 towards the shaving surface 16. With less force required, the user is able to enjoy a more effortless shave.

Referring to FIG. 17, blade 7 is attached to body 21 by means of screw 19. Used shavings and lather exit through ports 18 through covers 17. Safety guard 23 is conventional and keeps razor blade 7 at a fixed distance from shaving surface 16.

FIG. 19 shows yet another embodiment of this invention which is similar to that of FIG. 18, the primary difference being that plastic hinges 29 are deleted. This approach may be used in low-priced systems where the cost factor is paramount and where some slipping askew of blade-housings 12 on steep contours is judged to be acceptable.

Another embodiment of the invention is shown in FIG. 20, wherein the blade-housings 41 are oriented angularly relative to the direction of shaving. Compared to FIG. 15, fewer blade-housings are required with this approach. Now, adjacent blade-housings 41 in only a single row are able to shave the shaving surface without leaving unshaved ribbons between adjacent blade-housings.

FIG. 21 shows another embodiment of this invention. Here, handle 52 is connected to a rigid razor-housing cover 42. Resilient springs 43 are attached to said rigid razor-housing cover 42 on one side and blade-housings 12 on the opposite side. During shaving of a contoured shaving surface 16, blade-housings 12 flex and/or move as dictated by the slope of said shaving surface. Springs 43 compress and expand in order to accommodate said blade-housings 12 movement.

What is claimed is:

1. A razor system containing a group of three or more individual blade-housing means that are adapted to move with respect to each other in order to conform to and shave any rounded or variably contoured part of the body, wherein any single shaving stroke cuts a wide, unbroken, shaving swath, comprising:

handle means, and connecting means carried by said handle means, and a group of three or more individual blade-housing means adapted to move with respect to each other in order to conform to the shape of the surface being shaved, and carried by said connecting means, wherein these individual blade-housing means are arranged relative to each other so that, in any single shaving stroke, unshaved ribbons of shaving surface caused by gaps between adjacent individual blade-housing means are avoided, and at least one separate blade carried by each individual blade-housing of said plurality of individual blade-housing means.

2. The system of claim 1 wherein said connecting means are rib means.

3. The system of claim 1 wherein said connecting means are resilient spring means.

4. The system of claim 1 wherein said connecting means is a resilient, soft, rubbery material.

5. The system of claim 4 wherein said resilient, soft, rubbery material is polyurethane foam.

6. The system of claim 1 wherein said plurality of individual blade-housing means is arranged in two parallel rows and wherein the second row is staggered relative to the first row.

7. The system of claim 1 wherein said plurality of individual blade-housing means has at least one individual blade-housing means connected to another individual blade-housing means by hinge means.

8. The system of claim 6 wherein each of said individual blade-housing means in each of said rows is connected to at least one other individual blade-housing means by hinge means.

9. The system of claim 8 wherein said hinge means extends along the side of an individual blade-housing means and consists of a thin, flexible strip that is attached to an adjacent individual blade-housing means.

10. The system of claim 2 wherein said rib means comprises a plurality of flexible, resilient rods, with at least one rod connected to and carrying one of said individual blade-housing means.

11. The system of claim 2 wherein said rib means comprises a pair of arms wherein the ends of said arms are attached to the ends of said plurality of individual blade-housing means.

12. The system of claim 11 wherein the ends of said arms are attached to the ends of said plurality of individual blade-housing means by swivel means.

13. The system of claim 10 wherein said plurality of flexible, resilient rods has at least one rod connected to said individual blade-housing means by swivel means.

14. The system of claim 1 wherein said system is comprised of a handheld, flexible group of individual blade-housing means with means for grasping said group of individual blade-housing means.

15. The system of claim 2 wherein said handle means and said rib means are combined into finger-holding means in order to create a handheld flexible, contour-following sectionalized razor system.

16. A razor system containing a hinged flexible chain of individual blade-housing means that is adapted to flex in order to conform to and shave any rounded or variably contoured part of the body, comprising:

handle means, and connecting means carried by said handle means, and a group of three or more individual blade-housing means, interconnected by hinge means to form a flexible chain of individual blade-housing means, carried by said connecting means, and at least one separate blade carried by each individual blade-housing of said group of three or more individual blade-housing means.

17. The system of claim 16 wherein said connecting means are rib means.

18. The system of claim 16 wherein said connecting means are resilient spring means.

19. The system of claim 16 wherein said connecting means is a resilient, soft, rubbery material.

20. The system of claim 17 wherein said rib means comprises a group of flexible, resilient rods, with at least one rod connected to and carrying one of said individual blade-housing means.

21. The system of claim 20 wherein said group of flexible, resilient rods has at least one rod connected to said individual blade-housing means by swivel means.

22. The system of claim 17 wherein said rib means comprises a pair of arms wherein the ends of said arms are attached to the ends of said hinged flexible chain of individual blade-housing means.

23. The system of claim 16 wherein said system is comprised of a handheld group of said individual blade-housing means with means for grasping said group of individual blade-housing means.

24. A razor system containing a group of three or more individual blade-housing means that are adapted to move with respect to each other in order to conform to and shave any rounded or variably contoured part of the body, wherein any single shaving stroke cuts a wide shaving swath, comprising:

handle means, and long, resilient rib means carried by said handle means, and a group of three or more individual blade-housing means adapted to move with respect to each other in order to conform to the shape of the surface being shaved, and carried by said long, resilient rib means, wherein these individual blade-housing means are separated from each other by narrow gaps, and at least one separate blade carried by each individual blade-housing means of said group of three or more individual blade-housing means.

25. The system of claim 24 wherein the ends of said long, resilient rib means are attached to said group of three or more individual blade-housing means by swivel means.

26. The system of claim 25 wherein said swivel means are omnidirectional swivel means.

27. The system of claim 26 wherein said omnidirectional swivel means is a soft rubbery material.

28. The system of claim 27 wherein said soft rubbery material is polyurethane foam.

29. The system of claim 26 wherein said omnidirectional swivel means are ball-joint swivels.

30. The system of claim 25 wherein said swivel means are unidirectional swivel or hinge means.

31. A razor system containing two individual blade-housing means that are adapted to move with respect to each other in order to conform to and shave any rounded or variably contoured part of the body, wherein any single shaving stroke cuts a moderately wide, unbroken shaving swath, comprising:

handle means, and rib means carried by said handle means, and two individual blade-housing means adapted to move with respect to each other in order to conform to the shape of the surface being shaved, and carried by said rib means, wherein these two individual blade-housing means are arranged relative to each other so that, in any single shaving stroke, an unshaved ribbon of shaving surface caused by the gap between said two individual blade-housing means is avoided, and at least one separate blade carried by each individual blade-housing of said two individual blade-housing means.

32. The system of claim 31 wherein the ends of said rib means are attached to said two individual blade-housing means by swivel means.

33. The system of claim 32 wherein said swivel means is a soft rubbery material.

34. The system of claim 33 wherein said soft rubbery material is polyurethane foam.

35. The system of claim 32 wherein said swivel means are resilient spring means.

* * * * *